United States Patent [19]

Hark

[11] 4,409,901

[45] Oct. 18, 1983

[54] APPARATUS FOR PERFORMING OPERATIONS ON A RAILWAY TRACK

[75] Inventor: William B. Hark, Reading, England

[73] Assignee: Pandrol Limited, London, England

[21] Appl. No.: 329,307

[22] Filed: Dec. 10, 1981

Related U.S. Application Data

[63] Continuation of Ser. No. 98,379, Nov. 27, 1979, abandoned.

[30] Foreign Application Priority Data

Nov. 30, 1978 [GB] United Kingdom ..... 46757/78

[51] Int. Cl.[3] ..... E01B 33/00; E01B 29/04

[52] U.S. Cl. ..... 104/7 B; 104/8; 254/43

[58] Field of Search ..... 104/1 R, 2, 7 R, 7 B, 104/8, 12, 16, 17 R, 17 A; 254/43

[56] References Cited

U.S. PATENT DOCUMENTS

| | | | |
|---|---|---|---|
| 2,693,769 | 11/1954 | Herlehy | 104/7 R X |
| 3,430,578 | 3/1969 | Stewart | 104/7 R |
| 3,494,297 | 2/1970 | Plasser et al. | 104/7 B |
| 3,552,320 | 1/1971 | Traupmann | 104/2 X |
| 3,832,952 | 9/1974 | Hurni | 104/7 B |

FOREIGN PATENT DOCUMENTS

| | | | |
|---|---|---|---|
| 1363704 | 8/1974 | United Kingdom | 104/2 |
| 1451966 | 10/1976 | United Kingdom | 104/7 B |
| 1493153 | 11/1977 | United Kingdom | 104/7 B |
| 553324 | 4/1977 | U.S.S.R. | 104/7 R |

*Primary Examiner*—Randolph Reese

*Attorney, Agent, or Firm*—Norbert P. Holler

[57] ABSTRACT

Apparatus for performing operations on a railway track, comprising an automatically actuated rail adjusting mechanism with parts to engage opposite edges of a flange of a flanged rail for adjusting the relative positions of a rail and a sleeper vertically and for adjusting the position of a rail by moving it sideways relative to a sleeper.

14 Claims, 8 Drawing Figures

APPARATUS FOR PERFORMING OPERATIONS ON A RAILWAY TRACK

Figure 1:
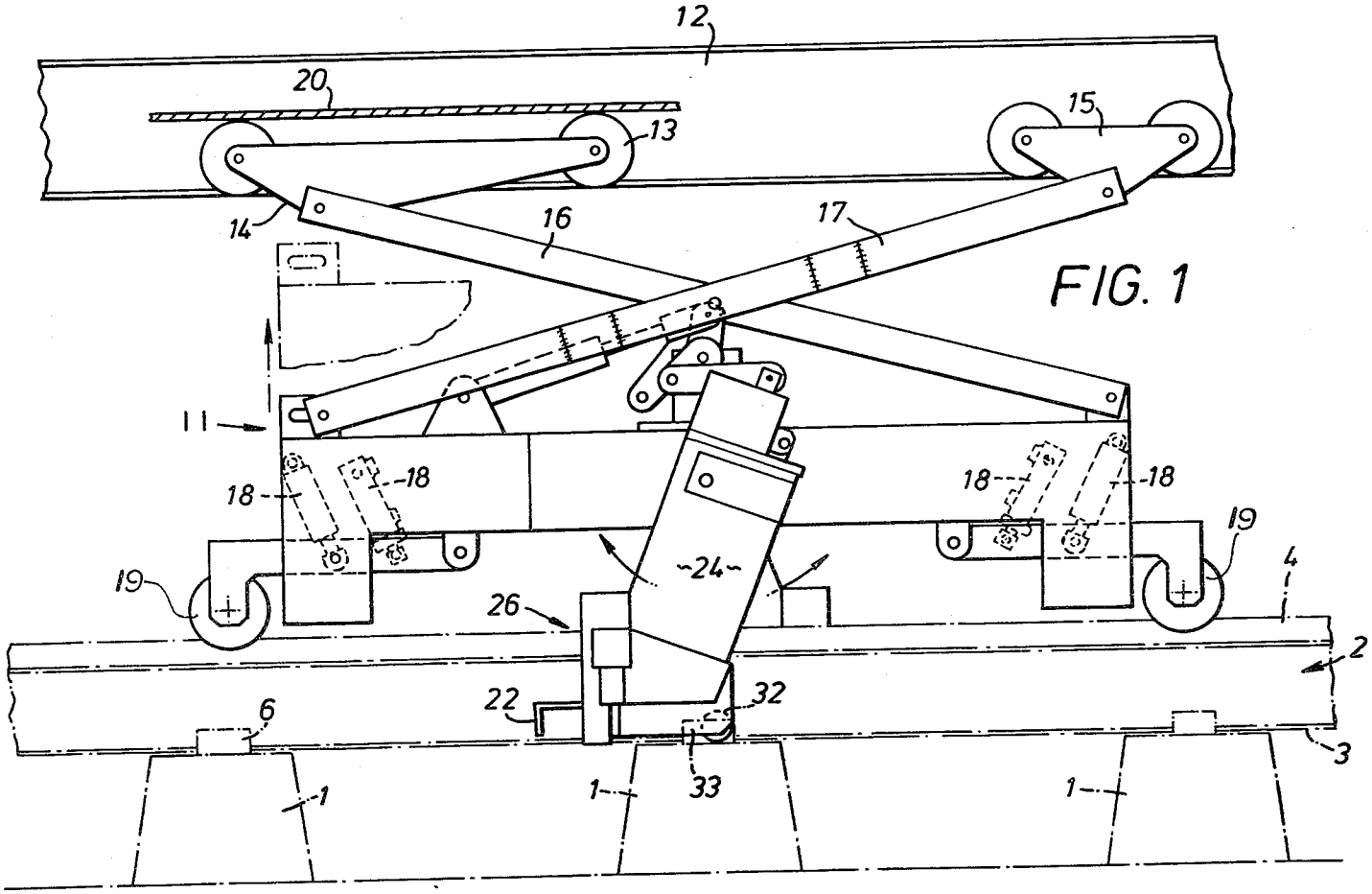

This is a continuation of application Ser. No. 98,379, filed Nov. 27, 1979, now abandoned.

According to the invention, there is provided apparatus for performing operations on a railway track, comprising automatic means including a rail adjusting mechanism with parts to engage opposite edges of a flange of a flanged rail for adjusting the relative positions of a rail and a sleeper vertically and for adjusting the position of a rail by moving it sideways relative to a sleeper.

This apparatus is preferably incorporated in a machine including a first carriage having wheels which run on the two running rails of a railway track and a second and smaller carriage constructed to be situated beneath and to run to and fro along the first carriage, the apparatus being carried by the second carriage.

If desired, the second carriage too may have running wheels, in which case these wheels may run on the two running rails or on a track provided by the first carriage. For example, beneath the first carriage there may be a central monorail along which run wheels at the top of the second carriage.

The first carriage may be caused to travel along the track at a substantially constant and very low speed, whilst the second carriage runs at a higher speed towards the front of the first carriage, then stops at a particular location and then the apparatus performs an operation there, by the completion of which the second carriage will be nearer than previously to the back of the first carriage. Then it may be caused to travel towards the front of the first carriage, stop at another location and perform an operation there, and so on. The locations at which the second carriage stops may be the locations of different railway sleepers or, in the case where there are no sleepers, for example where the rails are laid on a continuous slab extending along the track, the second carriage may stop at locations where the rail is held down.

The invention is of particular significance in relation to a railway track in which the two running rails are laid on a rail foundation or rail foundations (e.g. a continuous slab as mentioned above or wooden, steel or concrete railway sleepers), they are prevented from moving sideways by upward projections on the opposite sides of each rail foot (e.g. metal so-called "shoulders" cast in the concrete slab or sleepers are otherwise secured to them, ribs on base plates laid on the slab or sleepers, ribs and/or lugs pressed upwardly from steel sleepers, and so on) and they are held down by resilient clips (e.g. clips which are driven substantially parallel to the rail). The invention is of special importance in relation to a railway track in which the two running rails are to stand on electrically insulating pads which lie on concrete railway sleepers each having incorporated in it, before setting of the concrete, or otherwise secured to it, parts of two or four metal members which afford two upward projections in one half of the length of the sleeper, between which one rail foot is to be located, and two upward projections in the other half of the length of the sleeper, between which the other rail foot is to be located, each upward projection being intended to receive, in a passageway substantially parallel to the adjacent rail, the substantially straight leg of a resilient rail clip of the kind that looks rather like a letter e or a mirror image of a letter e when viewed from above (see British Patent Specification Nos. 869,385, 1,213,762, 1,497,908 and 1,510,224 for examples of such clips) the top and bottom limbs of the e or mirror image of an e bearing one on the rail foot and the other on a surface which, as seen from the rail, is beyond the substantially straight leg of the clip.

Apparatus according to the invention is intended to perform the following operations automatically:

1. Raise a too-low sleeper or, if the space between the top of a sleeper and the bottom of the rails is too large correct this, and 2. Centralize a rail between two upward projections.

Thus such apparatus comprises inter alia a mechanism for adjusting the position of a rail vertically, for adjusting the position of a sleeper vertically, and for moving a rail sideways.

Figure 2:
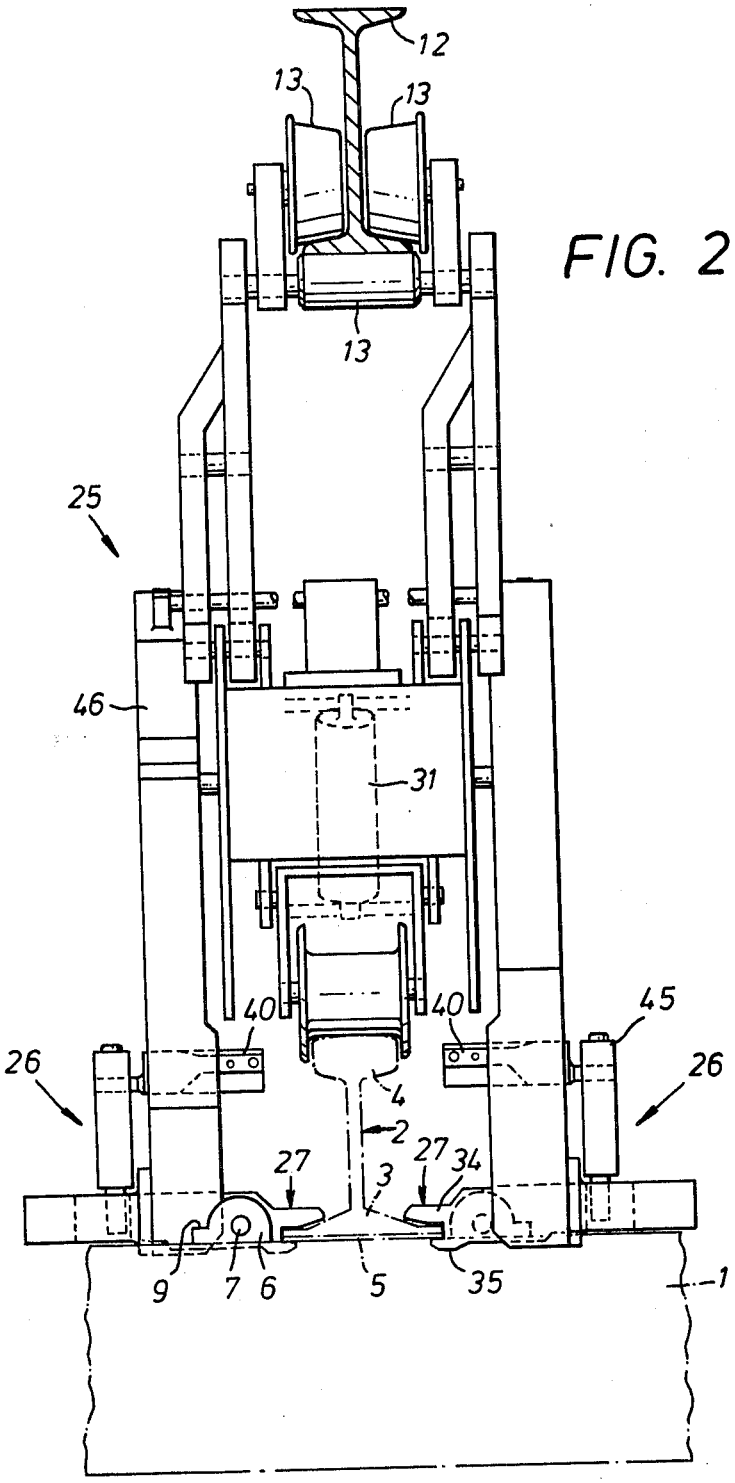
Figure 3:
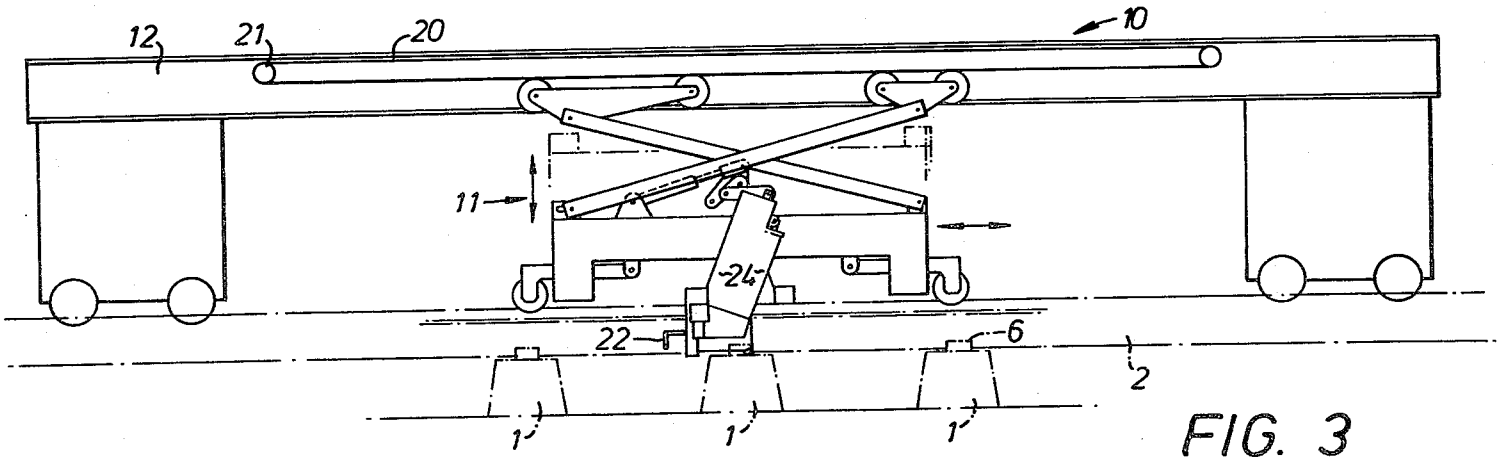
Figure 4:
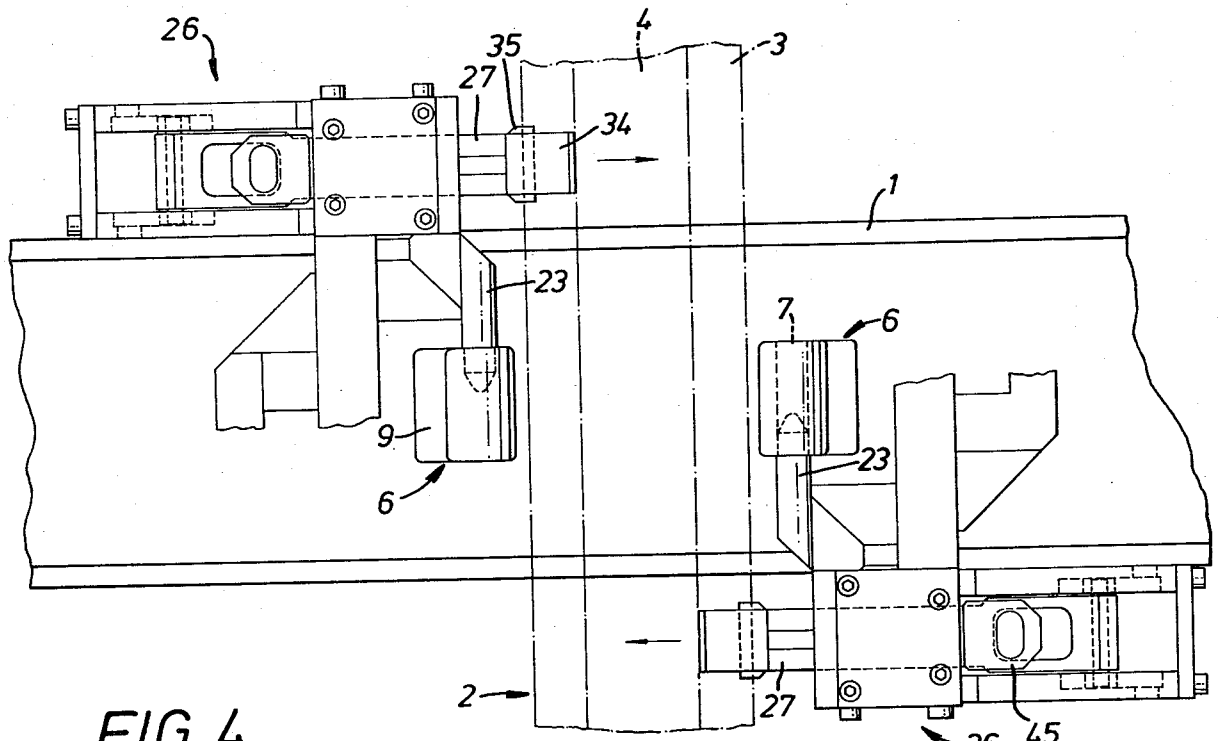
Figure 5:
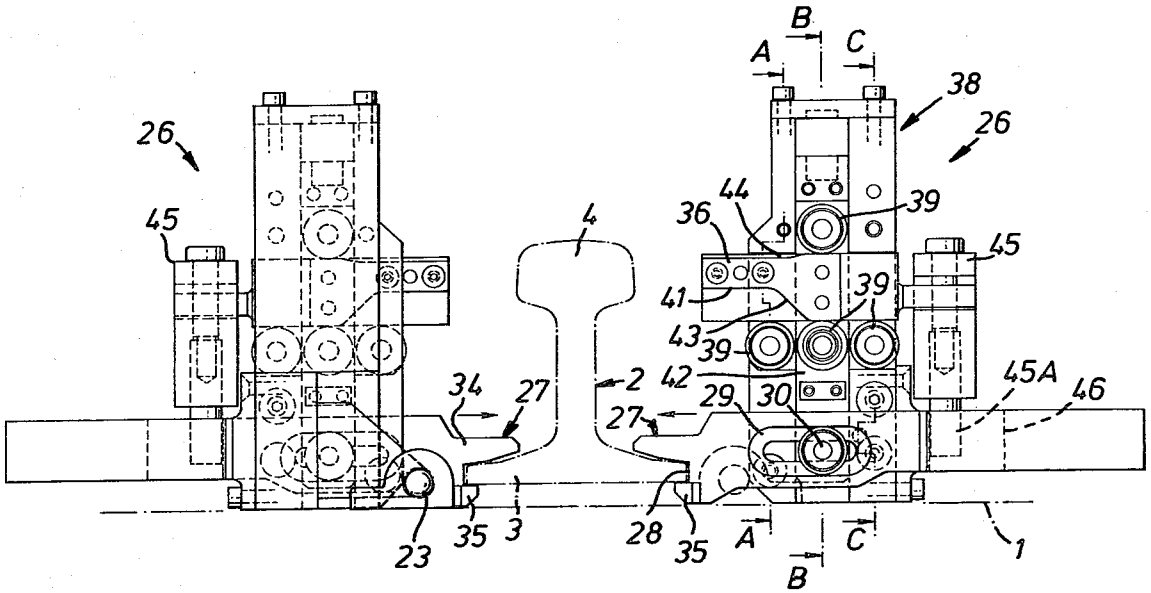
Figure 8:
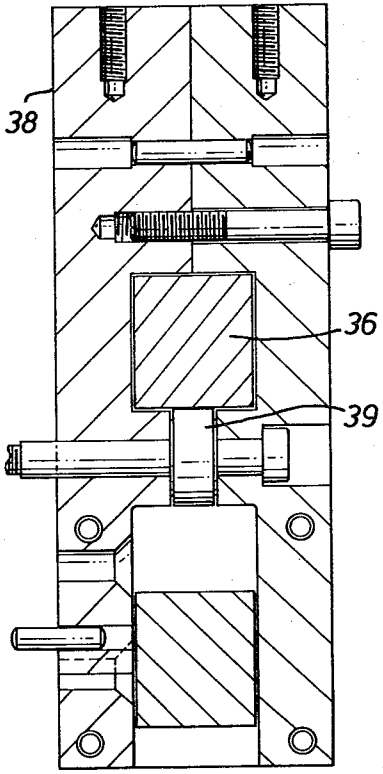
Figure 7:
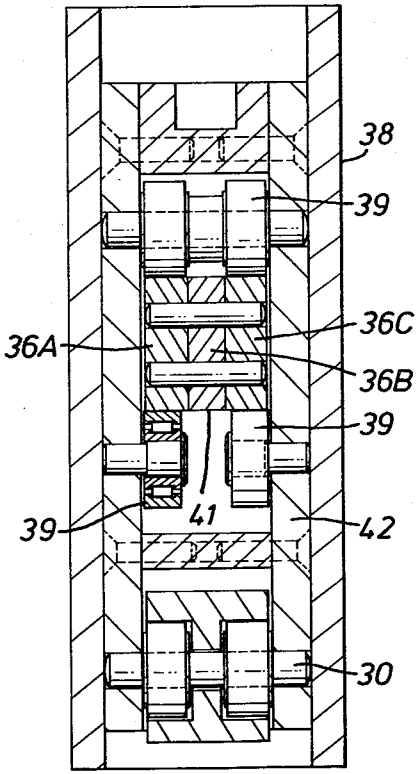
Figure 6:
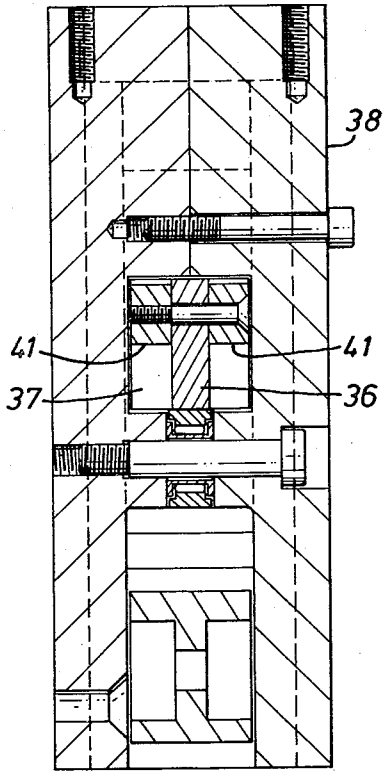

For a better understanding of the invention and to show how the same may be carried into effect, reference will now be made, by way of example, to the accompanying drawings, in which:

FIG. 1 is a diagrammatic side view of apparatus according to the invention shown incorporated in a machine which can include equipment for performing other operations in connection with a railway track, FIG. 2 is a diagrammatic end view illustrating part of the construction shown in FIG. 1, FIG. 3 is a schematic side view of the machine shown in FIG. 1 to illustrate how it may be incorporated into a railway vehicle serving to allow for continuous operation of the machine shown in FIGS. 1 and 2, FIG. 4 is a plan view of the apparatus according to the invention, FIG. 5 is a side view of the apparatus shown in FIG. 4, a plate being removed to show the construction, FIG. 6 is a sectional view taken along the line A—A in FIG. 5, FIG. 7 is a sectional view taken along the line B—B in FIG. 5, and FIG. 8 is a sectional view taken along the line C—C in FIG. 5.

FIG. 1 shows three of many similar concrete railway sleepers 1 across which lie two similar flange-footed railway rails 2, of which only one is shown, its flange being referenced 3 and its head 4. As shown in FIG. 2, each rail stands on an electrically insulating resilient pad 5 between upward projections 6 which prevent the rail moving sideways. There are four upward projections 6 on each sleeper, each being formed with a passageway 7 through it and being afforded by the upper end of a so-called "shoulder" of malleable cast iron, the lower end of which was incorporated in the concrete before setting of the concrete. On each edge of the flange of each rail there is to be placed an elongate electrical insulator (not shown) of substantially L-shaped cross-section, one limb of the L lying on the rail flange and electrically insulating the rail from a resilient steel rail clip (also not shown), part of which (a so-called "toe") presses downwardly on the rail flange through the above-mentioned limb of the insulator when another part of the clip (a so-called "straight leg") is driven into the passageway 7 in one of the upward projections 6. A third part (a so-called "heel") of the clip bears downwardly on a surface 9 of the same upward projection 6. The other limb of the L of the insulator electrically insulates the rail from the upward projection 6 and is provided with two lugs between which lies part of the upward projection 6 so that the insulator is prevented from moving far along the rail. The rail-and-fastening assembly thus far described is in accordance with the drawings and descriptions in our British Patent Specification No. 968,659, the "straight leg" "toe" and "heel" of the clip being the parts of the clip which in that specification are referred to as the "first portion", "third portion" and "fifth portion" and these being connected by a "second portion" (a so-called "rear arch") and a "fourth portion" (a so-called "front arch").

FIG. 3 diagrammatically shows a railway vehicle having a first carriage 10 having two bogies spaced about 5 meters apart as shown, the wheels of which run on the rails 2 of the railway track. The carriage 10 supports apparatus (not shown) comprising an engine which drives a pump or pumps of a hydraulic system which drives the carriage 10 at a low and constant speed to the left along the rails 2 and also operates mechanisms carried by the carriage 10 and by a second and smaller carriage 11.

Referring again to FIGS. 1 and 2, the carriage 10 includes two monorails comprising I beams 12 (only one is shown) on the lower flanges of which run wheels 13 mounted on plates 14 and 15. Pivotally connected to these plates are ends of arms 16 and 17 which are pivotally connected together at their centers and pivotally connected at their lower ends to the carriage 11. There are four sets of parts 13 to 17, one on each side of each I-beam 12. By operation of piston-and-cylinder devices 18, the carriage 11 can be raised to an upper position, shown in dotted lines, at which the carriage 11 can travel along the track without hitting anything with wheels 19 running along the rails 2 to guide the carriage 11. The carriage 11 can also occupy an intermediate position.

A taut steel cable 20 driven by a hydraulic motor 21 drives the wheels 13 and thereby drives the carriage 11 to and fro along the carriage 10 and beneath it. A sensing member 22 senses the position of one of the projections 6 of one of the sleepers 1 when the carriage 11 is moving to the left, i.e. towards the front of the carriage 10, and automatically brings the carriage 11 to a halt at about the appropriate position relative to two of the shoulders in the sleeper. Then the carriage 11 descends from its intermediate position to its lower position and operations commence.

Firstly a rounded-nose pin 23 carried on the carriage 11 is inserted in the passageway in each projection 6, at the opposite end to that in which the straight leg of a clip is subsequently inserted. Then by means of these pins the sleeper is lifted if it is too low, i.e. if there is too great a gap between the top of the sleeper and the bottom of the rail or the sleeper is pushed downwardly (or the rail lifted) if this gap is too small. Then the two rails are brought to central positions between the projections, then the four insulators are placed into their appropriate positions, then four clips are placed with their straight legs projecting into the passageways 7 and then the clips are driven fully home. As the straight legs of the clips run further into the passageways 7 the pins 23 are simultaneously ejected from the passageways.

To raise one or both ends of the sleeper when the four pins are inserted in the four passageways 7, two adjacent pins are together raised vertically and the other two pins are not raised or are raised together vertically. There are four mechanisms 24 each of which is swung around a horizontal axis to insert a pin 23 into a passageway 7 (the illustrated pin 23 is caused to swing anticlockwise); then the mechanisms 24, (at least two of them) are lifted. The pins 23 are withdrawn before the carriage 11 is moved.

FIGS. 4 to 8 illustrate diagrammatically a rail-adjusting mechanism 24 for acting on one rail, this being formed by two identical rail adjusting parts 26 diagonally symmetrical to one another, one on either side of the rail 2. Each rail adjusting part 26 has a rail lifting member 27 with a recess 28 to receive an edge of the rail flange 3 at a location one on either side of a sleeper 1; this might entail moving some ballast out of the way. The two lifting members 27 are operatively interconnected by levers and gearing, forming part of the mechanism 25 and illustrated diagrammatically in FIG. 2, and act on opposite edges of the rail flange 3 to adjust the position of the rail vertically or for moving it sideways and the mechanism works in conjunction with the rounded-nose pins 23 when they are inserted in the passageways 7 in the projections 6, forces being transmitted between the members 27 and pins 23.

The lifting member 27 has an elongate slot 29 in which a pin 30 slides. The pin 30 is mounted on a structure which can be raised and lowered by a ram 31 (FIG. 2) which in turn moves the pin 30 to move the rail 2.

In operation, the carriage 11 is dropped to its lower position and is centered relatively to one of the sleepers 1. This is achieved by wheels 32 having horizontal axes on the carriage 11 running in opposite directions on to the sleeper by the pivoting movements of the two mechanisms 24 while other wheels 33 with vertical axes ride on the outsides of the upward projections 6 (FIG. 1). The relative movement between the carriage 11 and the rail 2 caused by the wheels 33 running on the outsides of the projections 6 may be such as to cause the carriage 11 to be pulled onto the center line between the projections 6 as a horizontal adjustment. The wheels 32 that are contacting the sleeper are used as a reference point to judge the height of the pins 23 relatively to the passageways 7 in the projections 6 so that relative vertical adjustment can be achieved, so that the equipment is at the correct height to allow for insertion of the pins 23 in the passageways 7 (the pins 23 being fixed relatively to the wheels 32).

Initially, each lifting member 27 is retracted to either side of the rail 2. The recess 28 is defined by two fixed jaws, viz. an upper jaw 34 and a shorter lower jaw 35. To engage the foot of the rail 2, each lifting member 27 is closed towards the rail, between the sleepers, and because opposed sets of jaws 34, 35 are positioned relative to the center line of the carriage 11, which is not necessarily the center line of the rail, the profile of the jaws 34, 35 and the stroke of the lifting members 27 must be such as to clear the rail when the jaws are raised but to engage with the foot of the rail when dropping to it and past it in the case of the lower jaw 35. If the rail is offset relatively to the carriage 11, then one rail adjusting part 26 will engage before the other and so force has to be applied to bring the rail to the center line of the carriage 11.

By a leverage action between the pins 23, the parts 26 and the ram 31, the lifting members 27 are then moved vertically to cause relative motion between the sleeper and the rail, the pins 23 being all the time inserted in the passageways 7 of the projections 6, so that they can either lift the rail from the sleeper so as to reduce a heavy rail load on the sleeper rather than to lift the sleeper, or can lower the sleeper or can raise it relatively to the rail. This movement takes place simultaneously with any horizontal adjustment of the rail but begins before commencement of it and stops before the completion of horizontal adjustment. If, however, vertical movement is required to lift the sleeper from its lowest level, then such movements are arranged to start earlier in the cycle.

Because the pins 23 are rigidly fixed relatively to the carriage 11 during this operation, they provide the necessary reference points and are capable of only lifting the sleepers; in order to push down on the sleeper, more force is needed and so the whole weight of the carriage 11 is used to press down on the sleeper via the mechanisms 24. The wheels 32 are on sprung, pivotable axles to allow for this movement when force is applied on them over and above the dead weight of the equipment.

When the adjusting mechanism 25 has completed its work, the clips are then fitted by driving their straight legs into the respective passageways 7 and, in so doing, the straight legs of the clips take the weight and stress, if present, previously taken by the pins 23, which are progressively ejected from the passageways 7. The mechanisms 24 can then be pivoted clear of the rail and sleeper in the direction of the arrows in FIG. 1 and so the cycle is completed.

The construction of each part 26 is such that the pin 30 runs in the slot 29 to give the required horizontal movement and a retractable bolt 36 is mounted in a gap 37 in an operating head to give the vertical movement. The bolt 36 is mounted so as to run on needle roller bearings 39 and can be pulled by means of a ram 40 in and out of the head. The bolt 36 has ramp surfaces 41 which run on the needle roller bearings so as to raise or lower a vertical hollow pillar 42 in the head. The pillar 42 carries the pin 30 in the slot 29 and so raising and lowering of the pillar 42 will raise and lower the lifting member 27.

The ramp profiles of the bolt 36 are such as to allow a greater latitude of upward movement than downward movement, so that, with the bolt 36 initially retracted, it is then inserted into the head to bring the sleeper and the rail together if this be needed, the head being provided with a 45° ramp for the bolt 36 to run on this ramp enabling adequate movement to be achieved. The head is also provided with a shallower ramp which acts to separate the sleeper and rail if this be needed to facilitate horizontal movement, the shallower ramp allowing more force to be applied to separate the sleeper and rail but providing a smaller vertical adjustment than would be required if the sleeper and rail were to be brought together. The steeper ramp is shown at 43 and the shallower ramp is shown at 44. The bolt 36 is made up of three plates, the center one taking the load, the others forming the ramp surfaces.

The rail 2 is thus centralized between two of the upward projections 6 by the two rail adjusting mechanisms 24 operating on opposite sides of the rail either side of the sleeper, one of which mechanisms pushes the rail against the force exerted by the other. The two mechanisms are operatively connected together to allow equal increments of horizontal movement so as eventually to achieve centering of the rail relatively to the carriage. The bolt 36 is connected to a member 45 which is coupled to the rail lifting member 27, the member 45 having a pin 45A which is slidable in a slot in the member 27. It will be seen from the right-hand side of FIG. 5 that initial movement of the bolt 36 from its extreme right position towards the position shown will allow the member 27 to perform its rail-adjusting duties. Movement of the bolt 36 to the left will cause the pin 45A, which is in contact with a wall 46, at the end of the slot in the member 27, which is resiliently biassed towards the left, to allow the member 27 to move to the left until the bottom of the recess 28 in the member 27 abuts against the rail flange. Movement of the bolt 36 beyond this will cause the pin 45A to travel along the slot in the member 27 until it strikes the opposite end wall of this slot. When this occurs, further leftward movement causes the member 27 to perform its rail shifting function sideways.

When the above-described operations have been completed at or near one sleeper, the carriage 11, now near the right-hand or rear-end of the carriage 10, is moved rapidly to the left until it stops at the next sleeper. All the movements of the various parts are produced by hydraulic systems and controlled by a sequencing system.

It will be appreciated that apparatus in accordance with the invention may be constructed for working on one or more flanged rails at a time.

What is claimed is:

1. Apparatus for performing operations on a railway track, comprising automatic means for adjusting the relative positions of a flanged rail and a sleeper vertically and for adjusting the position of a flanged rail by moving it sideways relative to a sleeper, said automatic means including a rail adjusting mechanism with two diagonally symmetrical rail adjusting parts arranged to be juxtaposed to the opposite edges of the rail flange, each of said rail adjusting parts including a rail adjusting member having a recessed end portion defining an upper and a lower jaw adapted to receive therebetween a proximate edge region of the rail flange, and said rail adjusting parts further including means to operate the respective rail adjusting members (a) for moving said rail adjusting members so as to locate said upper and lower jaws thereof in positions to engage the rail flange from above and below, respectively, for lifting and lowering the rail and (b) for moving at least one of said rail adjusting members so as to locate the bottom of the respective end recess thereof in position to push against the associated rail flange for either shifting the rail sideways to or maintaining the rail in a desired location.

2. Apparatus according to claim 1, in which said rail adjusting mechanism is supported on a carriage, a ram being provided to raise and lower said rail adjusting parts clear of said rail and sleeper.

3. Apparatus according to claim 2, in which said carriage has wheels for running on the rails of a railway track.

4. Apparatus according to claim 3, in which said carriage is itself supported by a larger carriage and can run on a rail, said larger carriage having wheels which run on the two running rails of a railway track and the first-mentioned carriage being constructed to be situated beneath the larger carriage, and means being provided to cause the first-mentioned carriage to run to and fro along the larger carriage.

5. Apparatus according to claim 1, in which each of said rail adjusting parts carries a pin for substantially horizontal insertion in a substantially horizontal passageway in a respective rail clip-anchoring projection extending upwardly from a rail foundation and located on the same side of the rail flange as the rail adjusting part carrying that pin, and each of said rail adjusting parts includes means for moving its associated pin into and out of the passageway of the associated projection.

6. Apparatus according to claim 1, in which said rail adjusting mechanism has means to apply a force between a sleeper and a rail so as to tend to separate them in order to facilitate entry of the lower jaw of each of said rail adjusting members under the rail flange.

7. Apparatus according to claim 1, in which each rail adjusting member is slidably mounted in a head and is provided with a slot, a vertically movable pillar is mounted in said head and carries a pin which is slidable in said slot of said rail adjusting member, and a retractable bolt is provided in said head and has ramp surfaces upon which elements of said pillar can run and be guided to raise and lower the pillar for in turn raising and lowering said rail adjusting member, said slot in said rail adjusting member being substantially horizontal so that the latter can be moved towards the edge of a flanged rail and retracted from it.

8. Apparatus according to claim 7, in which each rail adjusting member is provided with resilient means which biases that member in use towards a rail, a ram being provided to move the rail adjusting member once it has contacted the rail, this ram also acting on said bolt to move it.

9. Apparatus according to claim 8, in which needle bearings are provided for said bolt to run on, the bolt comprising three adjacent plates, the outer two plates being formed with said ramp surfaces and the centre plate being arranged to take the load of the mechanism.

10. Apparatus according to claim 8, in which a restraining member is provided for restraining each rail adjusting member at the commencement of its working stroke against the bias of said resilient means, and means is provided to release the rail adjusting member from the restraint afforded by said restraining member, whereby each rail adjusting member is allowed to travel towards and reach a rail under the action of said resilient means and each said ram subsequently urges the associated rail adjusting member to urge the rail sideways.

11. Apparatus according to claim 1, wherein each of said rail adjusting parts is arranged for pivotal movement into and out of an operative position where the associated rail adjusting member is juxtaposed to the rail flange, and said upper jaw of each rail adjusting member is longer than the associated lower jaw so that the lower jaw can clear the rail flange when the respective rail adjusting part is pivoted into said operative position.

12. Apparatus according to claim 1, in which said rail adjusting parts are arranged to pivot in opposite directions towards their respective operative positions.

13. Apparatus according to claim 1, in which two said automatic means are provided, one for each running rail of a railway track, so that said operations can be performed respectively simultaneously on the two running rails of a railway track.

14. A railway vehicle provided with apparatus according to claim 1 or 13.

* * * * *